US006481073B1

(12) United States Patent
Sugahara

(10) Patent No.: US 6,481,073 B1
(45) Date of Patent: Nov. 19, 2002

(54) METHOD FOR MANUFACTURING INK JET PRINT HEAD

(75) Inventor: Hiroto Sugahara, Ama-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/133,372

(22) Filed: Aug. 13, 1998

(30) Foreign Application Priority Data

Sep. 10, 1997 (JP) ..... 9-245236

(51) Int. Cl.[7] ..... H04R 17/00

(52) U.S. Cl. ..... 29/25.35; 29/890.1; 29/847; 347/68; 347/71

(58) Field of Search ..... 29/DIG. 12, 890.1, 29/847, 852, 25.35, 527.5; 347/68, 71, 72, 69; 427/100

(56) References Cited

U.S. PATENT DOCUMENTS 5,016,028 A 5/1991 Temple
5,097,637 A 3/1992 Shepherd
5,248,998 A * 9/1993 Ochiai et al. ..... 346/140 R
5,485,663 A * 1/1996 Ochiai et al. ..... 29/25.35
5,502,472 A * 3/1996 Suzuki ..... 347/69
5,508,726 A 4/1996 Sugahara
5,513,431 A * 5/1996 Ohno et al. ..... 29/890.1
5,625,395 A * 4/1997 Imai ..... 347/71
5,646,661 A * 7/1997 Asai et al. ..... 347/69
5,657,063 A * 8/1997 Takahashi ..... 347/69
5,680,163 A * 10/1997 Sugahara ..... 347/71
5,682,187 A * 10/1997 Watanabe ..... 347/45
5,682,190 A * 10/1997 Hirosawa et al. ..... 347/94
5,688,391 A * 11/1997 Hayes ..... 204/478
5,801,731 A * 9/1998 Takahashi ..... 347/69
6,070,310 A * 6/2000 Ito et al. ..... 29/25.35
6,139,133 A * 10/2000 Ishikawa ..... 347/71
6,176,012 B1 * 1/2001 Ishimatsu ..... 29/890.1

* cited by examiner

*Primary Examiner*—Carl J. Arbes
*Assistant Examiner*—Minh Trinh
(74) *Attorney, Agent, or Firm*—Oliff & Berridge, PLC

(57) ABSTRACT

In the manufacture of an ink jet print head which ejects ink from ink jet grooves through nozzles by applying voltage to walls of the ink jet grooves that are formed of a piezoelectric material so as to deform the walls, a plurality of ejection factors, such as a groove width, groove depth, width of partition walls, and a piezoelectric constant of the piezoelectric material, which influence ejection of the ink, are selected as a combination and controlled so that the ink is ejected from the print head in a desired ejection state. When the groove depth and groove width of the jet ink grooves, for example, are selected as the combination of the ejection factors, the groove depth is corrected or controlled according to the groove width. Accordingly, the tolerances or allowable ranges of the ejection factors can be increased when manufacturing actuator substrates capable of ejecting ink in a desired ejection state, with a result of an improved yield of print heads.

20 Claims, 15 Drawing Sheets

Fig.1B

| GROOVE WIDTH A | GROOVE DEPTH B |
|---|---|
| $a_0 < A \leqq a_1$ | $B + b_3$ |
| $a_1 < A \leqq a_2$ | $B + b_2$ |
| $a_2 < A \leqq a_3$ | $B + b_1$ |
| $a_3 < A \leqq a_4$ | $B$ |
| $a_4 < A \leqq a_5$ | $B - b_1$ |
| $a_5 < A \leqq a_6$ | $B - b_2$ |
| $a_6 < A \leqq a_7$ | $B - b_3$ |

Fig.1C

| PIEZOELECTRIC CONSTANT P | GROOVE DEPTH B |
|---|---|
| $p_0 < P \leqq p_1$ | $B + b_3$ |
| $p_1 < P \leqq p_2$ | $B + b_2$ |
| $p_2 < P \leqq p_3$ | $B + b_1$ |
| $p_3 < P \leqq p_4$ | $B$ |
| $p_4 < P \leqq p_5$ | $B - b_1$ |
| $p_5 < P \leqq p_6$ | $B - b_2$ |
| $p_6 < P \leqq p_7$ | $B - b_3$ |

Fig.1D

| WIDTH OF PARTITION WALL C | GROOVE DEPTH B |
|---|---|
| $c_0 < C \leqq c_1$ | $B - b_3$ |
| $c_1 < C \leqq c_2$ | $B - b_2$ |
| $c_2 < C \leqq c_3$ | $B - b_1$ |
| $c_3 < C \leqq c_4$ | $B$ |
| $c_4 < C \leqq c_5$ | $B + b_1$ |
| $c_5 < C \leqq c_6$ | $B + b_2$ |
| $c_6 < C \leqq c_7$ | $B + b_3$ |

METHOD FOR MANUFACTURING INK JET PRINT HEAD

BACKGROUND OF THE INVENTION

1. Field of the Invention

The invention relates to a method for manufacturing an ink jet print head which ejects ink from nozzles by applying a pressure to ink contained in ink jet channels.

2. Description of Related Art

An ink jet recording apparatus includes an ink jet print head having multiple nozzles through which ink drops are ejected so as to print characters and diagrams on paper. The ink jet print head includes partition walls that define a plurality of inkjet channels which communicate with the respective nozzles. By applying a drive electric field to the print head to selectively bend the partition walls and change the volume of the ink jet channels, or instantaneously vaporizing the ink so as to generate bubbles, a pressure is applied to the ink contained in the ink jet channels so that the ink is ejected from the channels.

A change in the amount of ink ejected from the ink jet print head causes an increase or decrease in the amount of ink deposited on recording paper, and therefore has a great influence on the quality of resulting images. Conventionally, various ink ejection factors, such as the width and depth of the ink jet channels, which influence ejection of the ink, are respectively controlled to within certain standard ranges, so that the ink can be ejected in a desired ejection state so as to permit printing with a constant amount of ink. Thus, conventional ink jet print heads have been manufactured, while controlling each of the ink ejection factors to be held in its standard range.

In the conventional manufacturing method in which each ejection factor is controlled to within its standard range, however, the normal or desired ejection state or conditions cannot be achieved if even one of the ejection factors deviates from the standard range, thus causing a problem of reduced yield during manufacture of the print heads.

When an actuator substrate of the print head is formed with grooves that provide ink jet channels, for example, the grooves are formed by cutting the actuator substrate by a dicing process using diamond blades. The width of the diamond blades is set to be substantially equal to a given width of the grooves, so that the width and depth of the grooves are controlled to within their standard ranges. However, the width of the diamond blades may be gradually reduced due to wear of the blades during cutting, even if the diamond blades have a considerably high hardness. If such diamond blades are used to continuously cut a large number of actuator substrates, the width of the grooves formed in the actuators finally comes out of or deviates from the standard range. In the conventional manufacturing method in which the ink ejection factors are individually controlled to be within respective standard ranges, the actuators with grooves whose width is outside of the standard range are regarded as defective, and thus will be discarded, resulting in a reduction in the yield during manufacture of the print heads.

SUMMARY OF THE INVENTION

It is therefore an object of the invention to provide a method for manufacturing an ink jet print head, wherein an actuator substrate is suitably machined so that ink can be ejected in a desired ejection state to provide desired ink jetting characteristics, even in the case where one or more of a plurality of ejection factors is/are outside of the standard range(s).

To accomplish the above object, the invention provides a method for manufacturing an ink jet print head, wherein a plurality of ejection factors that influence ejection of ink are selected as a combination, and at least one of the ejection factors is controlled so that the ink is ejected in a predetermined ejection state.

In the method as described above, the plurality of ejection factors are combined and at least one of the factors is controlled so as to achieve a desired ink ejection state (ink drop ejection rate and amount of ejected ink drops), and therefore appropriate ranges of the ejection factors can be broadened, as compared with the conventional method where each of the ejection factors is set to within its standard or specified range so as to achieve the desired ejection state. Accordingly, the ink jet print head can be easily machined during its manufacture, irrespective of whether the print head is of an actuator type using a piezoelectric material or a bubble type using bubbles, with a result of an improved yield.

In the manufacturing method as described above, the groove depth and width of the ink grooves may be selected as a combination of the ejection factors, and the groove depth is corrected according to the groove width.

In this case, the ink ejection state or jetting characteristics can be easily controlled by combining the groove depth of the ink grooves that can be easily monitored and controlled, and the groove width.

In the method of the invention as described above, the ink jet print head may be formed with a plurality of ink grooves such that at least one side wall of each of the ink grooves is formed of a piezoelectric material, and a plurality of nozzles that respectively communicate with the ink grooves. In operation, the above-indicated at least one side wall is deformed upon application of a voltage thereto, so that the ink is ejected from each of the ink grooves through a corresponding one of the nozzles. In this manufacturing method, the piezoelectric constant of the piezoelectric material and the groove depth of the ink grooves may be selected as the combination of the ejection factors, and the groove depth may be corrected according to the piezoelectric constant.

In manufacturing the ink jet print head in which the ink is ejected through the nozzles due to changes in the volume of the ink grooves, the ejection state of the ink can be easily controlled by combining the groove depth that can be easily monitored and controlled, and the piezoelectric constant.

In the method of the invention as described above, the ink jet print head may be formed with a plurality of ink grooves such that at least one side wall of each of the ink grooves includes a piezoelectric material and the ink grooves are separated from each other by a plurality of partition walls. The ink jet print head may also be formed with a plurality of nozzles that respectively communicate with the ink grooves. In operation, the above-indicated at least one side wall is deformed upon application of a voltage thereto, so that the ink is ejected from each of the ink grooves through a corresponding nozzle. In this manufacturing method, the width of the partition walls on the opposite sides of each ink groove, and the groove depth of the ink grooves may be selected as the combination of the ejection factors, and the groove depth may be corrected according to the width of the partition walls. In the ink jet print head in which the ink is ejected from the nozzles due to deformation of the ink jet grooves, the ink ejection state can be easily controlled by combining the ink groove depth that can be easily monitored and controlled, and the width of the partition walls.

In the method of the invention as described above, the ink jet print head may be formed with a plurality of ink grooves such that at least one side wall of each of the ink grooves includes a piezoelectric material and the ink grooves are separated from each other by a plurality of partition wall. The ink jet print head may also be formed with a plurality of nozzles that respectively communicate with the ink grooves. In operation, the above-indicated at least one side wall is deformed upon application of a voltage thereto, so that the ink is ejected from each of the ink grooves through a corresponding nozzle. In this manufacturing method, at least two of the groove depth of the ink grooves, groove width of the ink grooves, piezoelectric constant of the piezoelectric material, diameter of the nozzles, and the width of the partition walls on the opposite sides of each ink groove may be selected as the combination of the ejection factors.

In the ink jet print head in which the ink is ejected from the nozzles due to changes in the volume of the ink grooves, the ejection factor which can be most easily controlled can be selected, depending upon manufacturing conditions, from the various kinds of ejection factors.

In the method for manufacturing an ink jet print head as described above, each of the ink grooves may be at least partially defined by a wall formed of a piezoelectric material. In operation, the wall is deformed upon application of a voltage thereto so that the ink is ejected from the print head due to a change in the volume of the ink groove.

In the ink jet print head adapted to eject ink from nozzles by deforming the wall defining each ink groove and changing the volume of the ink groove, appropriate ones of the ejection factors as described above may be selected which include the one which can be easily monitored and controlled, so that the ink ejection state can be easily controlled.

BRIEF DESCRIPTION OF THE DRAWINGS

A preferred embodiment of the invention will be described in detail with reference to the following figures wherein.

DETAILED DESCRIPTION OF THE PREFERRED EMBODIMENT

The invention will be described in detail with reference to FIG. 1(A) through FIG. 10(B).

Figure 5:
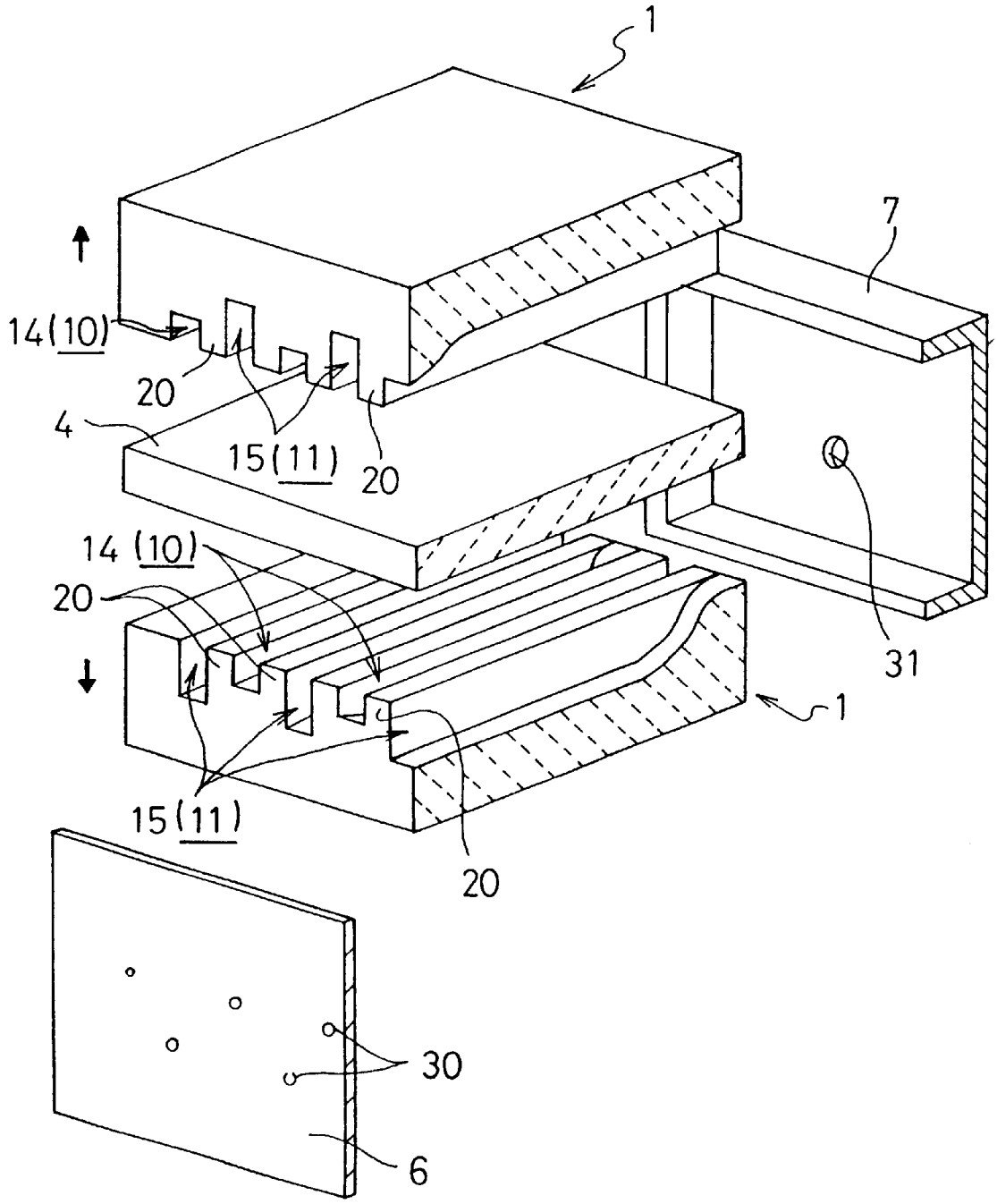
FIG. 5 is an exploded, perspective view of a principal portion of an ink jet print head.
Figure 6:
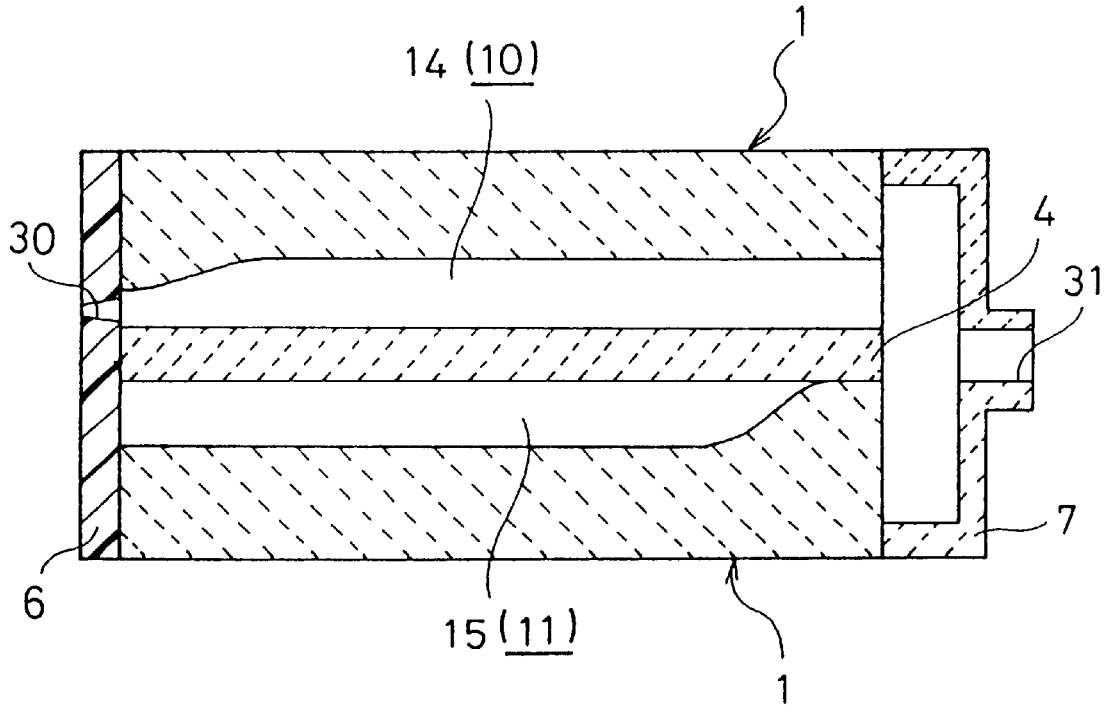
FIG. 6 is a vertical cross-sectional view of the ink jet print head.

An ink jet print head produced according to the method of the invention includes a pair of actuator substrates 1, 1, and a plate member 4 that is fixed to the actuator substrates 1, 1 to connect the substrates to each other, as shown in FIG. 5. Each of the actuator substrates 1 is constructed by laminating or stacking a plurality of layers made of a piezoelectric material, such as lead zirconate titanate (PZT) ceramics or lead titanate (PT) ceramics.

Figure 4A:
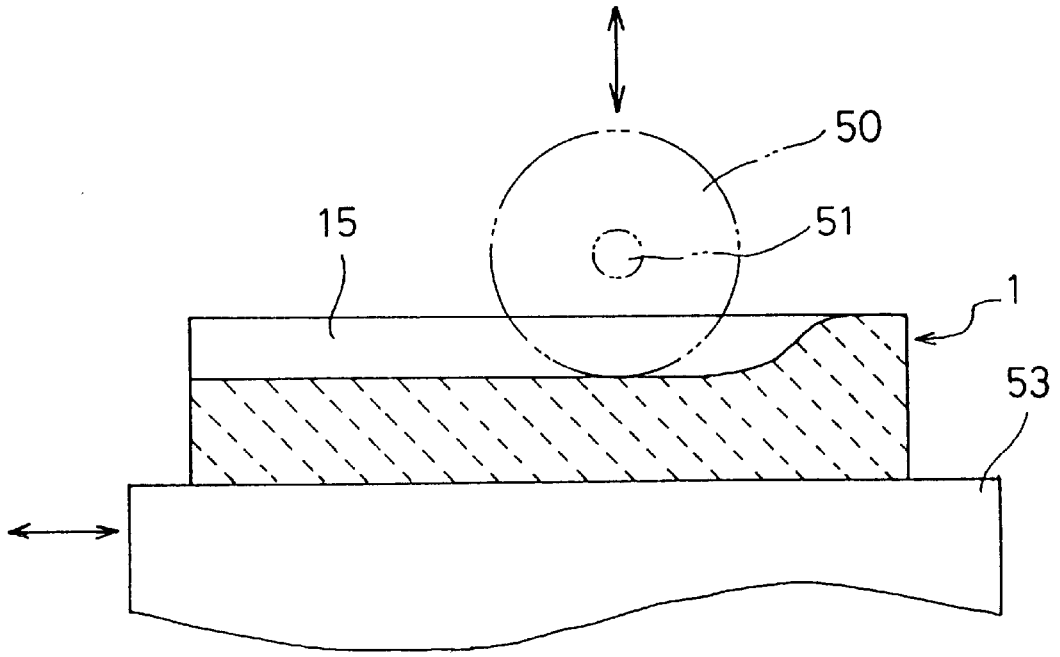
FIG. 4(A) and FIG. 4(B) are a side view and a front view, respectively, showing a method of forming grooves in an actuator substrate by a dicing process.
Figure 4B:
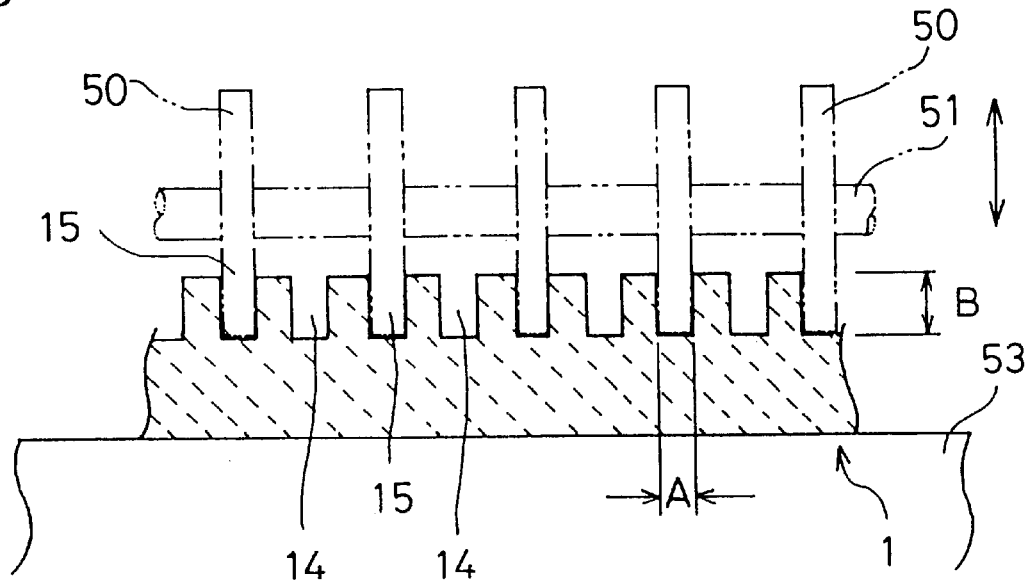

As shown in FIGS. 4(A) and 4(B), a plurality of ink jet grooves 14 and dummy ink grooves 15 are formed in the upper surface of each actuator substrate 1 which faces the plate member 4, by a dicing process using diamond blades 50. As shown in FIG. 5, the ink jet grooves 14 are formed with a certain depth to extend from one end of the actuator substrate 1 (left end in FIG. 5) to the other end (right end in FIG. 5) of the substrate. The dummy ink grooves 15 are formed with a certain depth to extend from one end of the actuator substrate 1 to a position close to the other end, such that an end portion of each dummy ink groove 15 close to the other end is raised to be flush with the upper face of the actuator substrate 1. The thus formed ink jet grooves 14 and dummy ink grooves 15 are alternately arranged in parallel with each other, with partition walls 20 interposed therebetween, and a plurality of layers of a piezoelectric material, which constitute the mutually facing partition walls 20, are polarized in opposite directions.

Electrodes (not shown) that include conductive layers made of, for example, Ni are formed on side faces of the partition walls 20 which provide inner walls of the ink jet ink grooves 14 and dummy ink grooves 15. When a voltage is applied to a pair of partition walls 20, 20 on the opposite sides of each ink jet groove 14, the mutually facing partition walls 20, 20 are caused to deform inwardly and outwardly of the groove 14, so that a pressure is applied to ink contained in the ink jet groove 14. As a result, the ink is ejected from nozzles which will be described later.

The above-indicated pair of actuator substrates 1, 1 formed as described above are fixedly connected to each other, via the plate member 4 in the form of a flat plate made of a ceramic material or a resin material, such that the ink jet grooves 14 of one of the actuator substrates 1 are opposed to or aligned with the dummy ink grooves 15 of the other actuator substrate 1. The opposite major surfaces of the plate member 4 are fluid-tightly bonded to the upper faces of the respective actuator substrates 1 in which the grooves 14, 15 are formed, by use of an adhesive containing epoxy resin. As a result, the ink jet grooves 14 of the actuator substrate 1 are covered with the plate member 4, so as to form ejection channels 10 which provide ink flow paths that are open at their front and rear ends. The dummy ink grooves 15 are also covered with the plate member 4, so as to form non-ejection channels 11 having front ends that are open to the outside, and rear ends that are sealed due to abutting contact between the upper face of the actuator substrate 1 and the plate member 4. In this manner, an assembly of the actuator substrates 1 and the plate member 4 is fabricated.

A nozzle plate 6 is bonded to one end face of the assembly of the actuator substrates 1 and plate member 4 provided with the ejection channels 10 and non-ejection channels 11, using the adhesive containing epoxy resin as described above. The nozzle plate 6 is formed with a plurality of nozzles 30 that correspond to the ejection channels 10, so that an ink fluid in the form of, for example, ink drops is ejected from the ejection channels 10 through the nozzles 30. The nozzle plate 6 is formed of a plastic material, such as polyalkylene or (for example, ethylene) terephthalete, polyimide, polyether imide, polyether ketone, polyether sulfone, polycarbonate, and cellulose acetate.

On the other hand, a manifold member 7 is bonded to the other end face of the assembly of the actuator substrates 1 and the plate member 4. An ink supply port 31 is formed at a central portion of the manifold member 7, so that the ink is supplied from an ink tank (not shown) into the print head through the ink supply port 31. Thus, the manifold member 7 provides an ink supply path that communicates with all of the ejection channels 10.

A method for manufacturing the ink jet print head constructed as described above will be now described.

Initially, a flat plate is prepared by laminating or stacking a plurality of layers of a piezoelectric material that are polarized, and this flat plate is formed by slicing into strip-like bodies, to thus provide each of the actuator substrates 1. Then, the actuator substrate 1 is mounted on a dicing device for cutting the substrate 1 by a dicing process, so that the ink jet grooves 14 and dummy ink grooves 15 are formed in the substrate 1 according to a grooving procedure as described below.

Figure 1A:
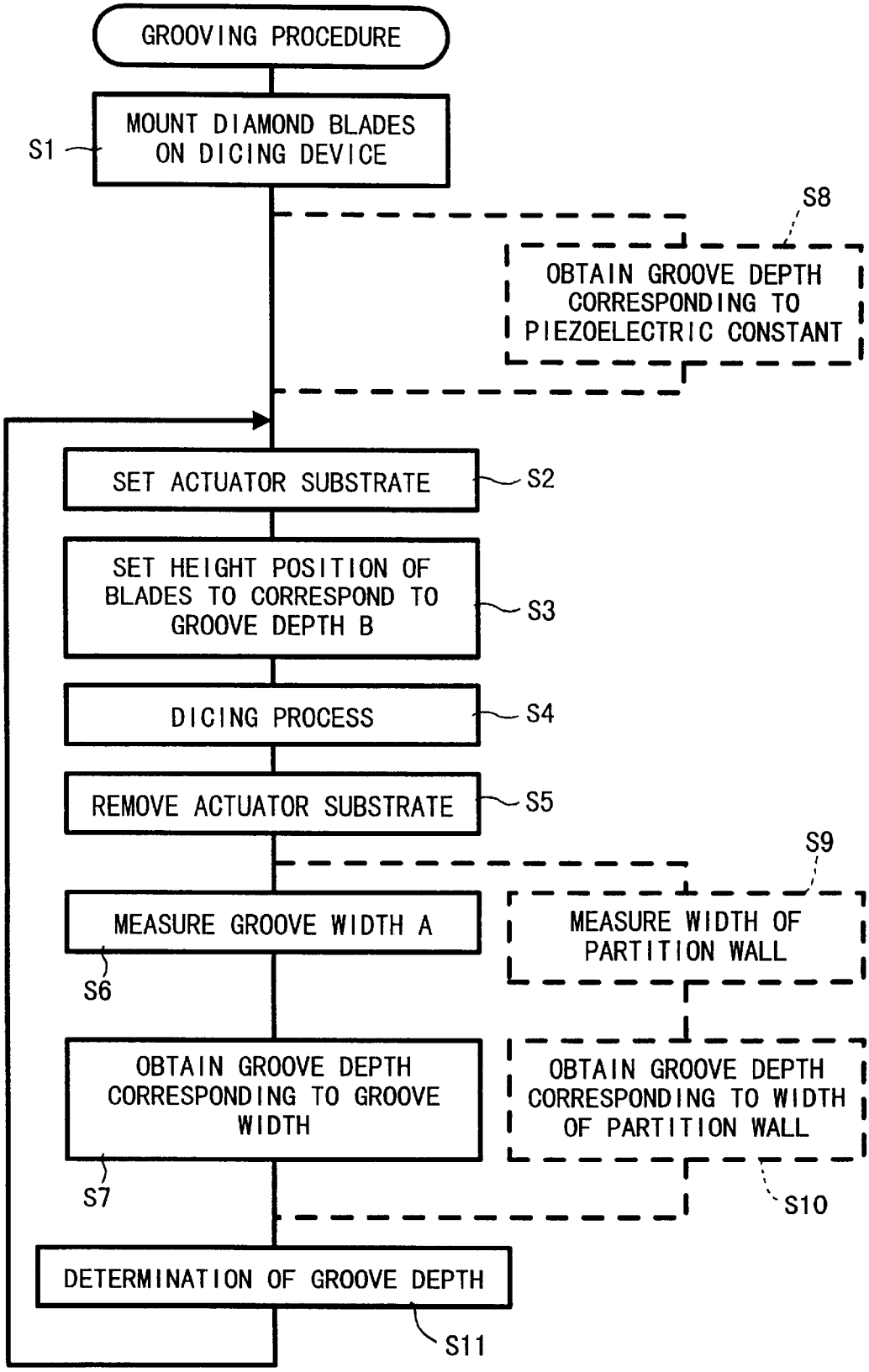
FIG. 1(A) is a flow chart showing the procedure of forming grooves in actuator substrates by machining according the invention, and FIGS. 1(B), 1(C) and 1(D) each show a table for determining groove depth in accordance with a different embodiment of the invention.

Initially, dummy ink grooves 15 are formed in the actuator substrate 1, and then ink jet grooves 14 are formed in the substrate 1 such that each of the ink jet grooves 14 are located between corresponding dummy ink grooves 15. This order of forming the grooves 14, 15 may be reversed. The formation of the inkjet grooves 14 will be described in more detail. As shown in FIG. 1(A), a plurality of sheets of diamond blades 50 for forming the ink jet grooves 14 by cutting are mounted on the dicing device in step S1 of FIG. 1(A). Each of the diamond blades 50 has a blade width that corresponds to the width of each ink jet groove 14, and the diamond blades 50 are arranged at the same pitch at which the ink jet grooves 14 are provided.

After the actuator substrate 1 is set on a mount base 53 in step S2, the position (height) of the diamond blades 50 during the dicing process is set in step S3 so that the height of the blades 50 corresponds to the groove depth B of the ink jet grooves 14. Thereafter, a command to start the dicing process is generated to a process control apparatus, so that the ink jet grooves 14 are formed in the ink jet actuator substrate 1 by dicing in step S4. When the dicing process for forming the grooves 14 is finished, the actuator substrate 1 is removed or detached from the dicing device in step S5.

According to a preferred embodiment shown in FIGS. 1(A) and 1(B), in the next step, the groove width A of all or part of the ink jet grooves 14 is measured in step S6, and a groove depth that corresponds to the measured groove width is obtained in step S7. More specifically, as sown in FIG. 1(B), if the groove width A is in a target center-value range of a3<A≦a4, the groove depth is set to a target center value B in step S3 when the ink jet grooves 14 are formed in the actuator substrate 1 in the next cycle of the dicing process. If the groove width A is smaller than the above-indicated target range, namely, if the width A is in the range of a0<A≦a3, the groove depth is set to a larger value than the center value B, by adding b1, b2, b3 to the value B depending upon a deviation of the groove width A from the target center-value range. If the groove width A is greater than the above-indicated range, namely, if the width A is in the range of a4<A≦a7, the groove depth is set to a smaller value than the center value B by subtracting b1, b2, b3 from the value B, depending upon a deviation of the groove width A from the target center-value range.

Figure 2:
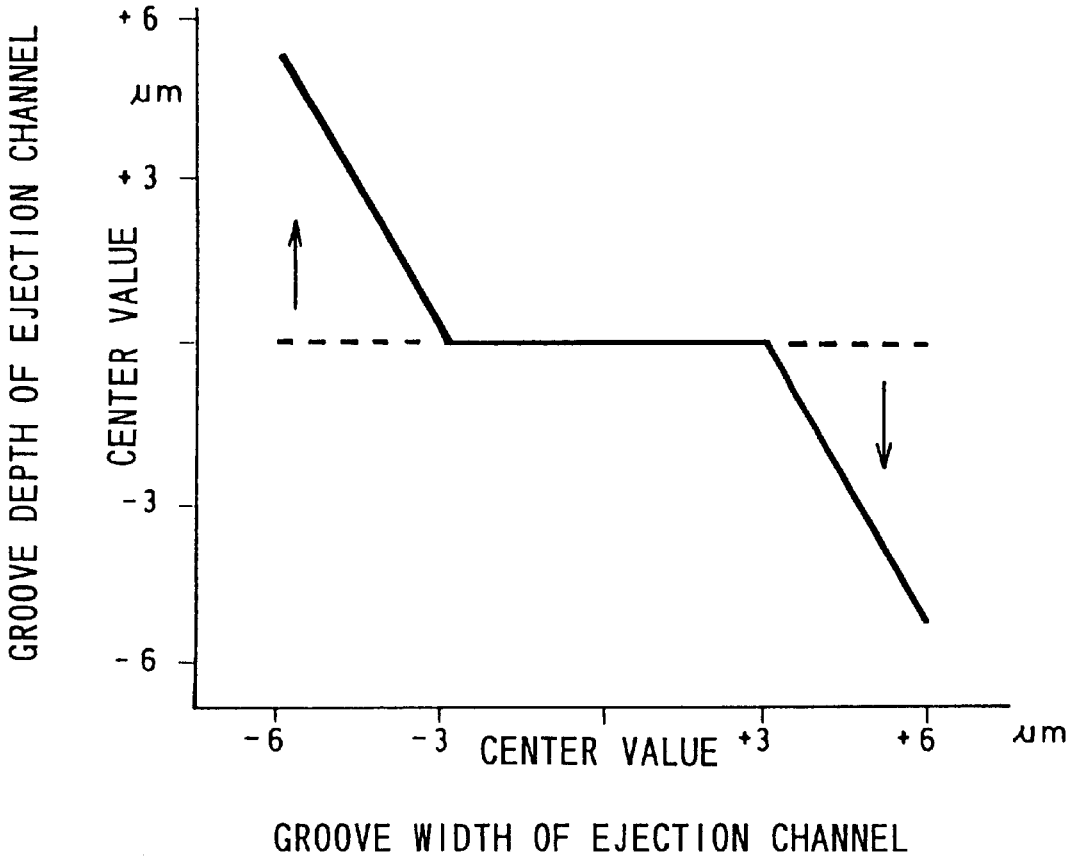
FIG. 2 is a graph showing the relationship between the groove width and the groove depth.
Figure 3A:
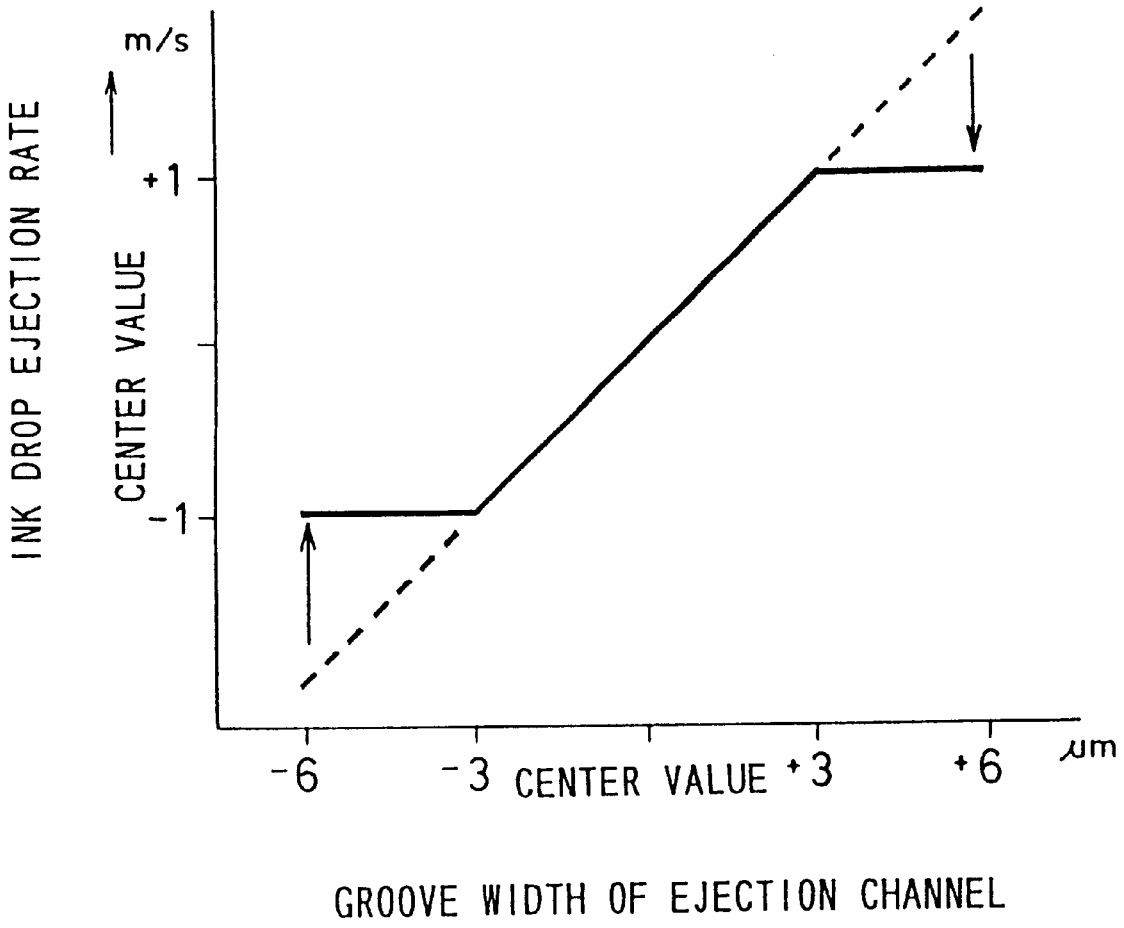
FIG. 3(A) is a graph showing the groove width that is controlled according to the groove depth, and the ink drop ejection rate.
Figure 3B:
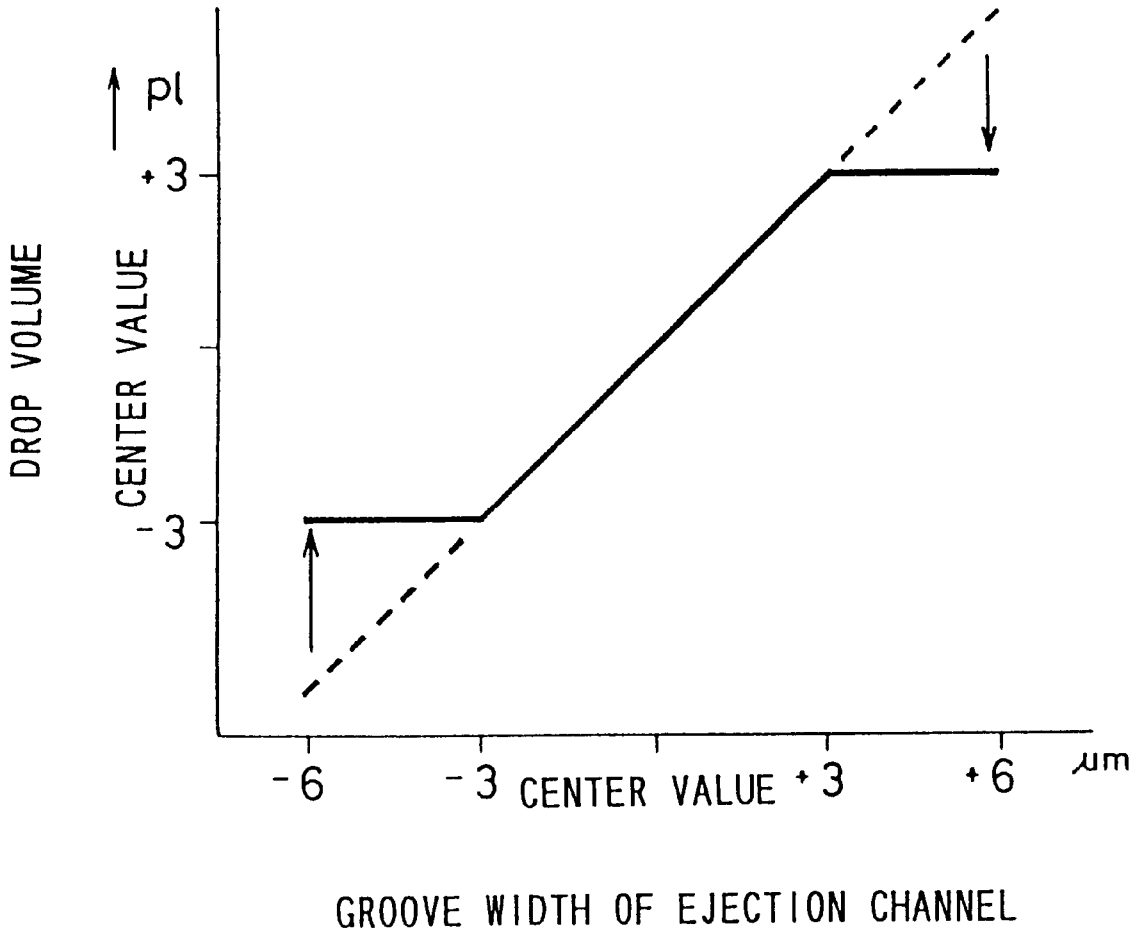
FIG. 3(B) is a graph showing the groove width that is controlled according to the groove depth, and the drop volume.

The table used in step S7 and shown in FIG. 1(B), which indicates the correspondence or relationship between the groove width A and the groove depths B, is prepared in advance, so that changes in the ink drop ejection rate or speed due to changes in the groove width A are corrected by suitably controlling the depth of the ink jet grooves 14 or ejection channels, as shown in the graphs of FIG. 2 and FIGS. 3(A) and 3(B), so as to cause the ink jet print head to eject ink drops in a predetermined ink ejection state. Since the ink drop ejection rate is increased with an increase in the groove width or groove depth of the ejection channels, the groove depth B is increased as shown in FIG. 2 if the groove width A becomes smaller than the target center-value range a3<A≦a4, so as to correct the ink drop ejection rate to be within its target center-value range. If the groove width A is increased, on the other hand, the groove depth B is reduced as shown in FIG. 2, so that the ink drop ejection rate is corrected to be within the target center-value range. Since the volume of ink drops ejected has substantially the same relationship with the groove width and groove depth, this volume may be corrected in the same manner by suitably controlling the groove depth.

The graph shown in FIG. 2 has a center value of groove depth of 230 μm and a center value of groove width of 60 μm. The graph shown in FIG. 3(A) has a center value of ejection rate of 8 m/s. The graph shown in FIG. 3(B) has a center value of drop volume of 40 pl.

As described above, the groove depth that corresponds to canges in the groove width due to dimensional errors of the diamond blades 50 themselves, or wear of the blades 50, is read from the table as described above, and a new actuator substrate 1 is set in the dicing device (S2), and subjected to a dicing process (S4) based on the groove depth B obtained in the previous cycle. The steps of measuring the groove width A and obtaining the groove depth B corresponding to the measured groove width A need not be executed in every cycle.

The ink ejecting state of the inkjet print head is also influenced by the width of the partition walls 20, diameter of the nozzle 30, and the piezoelectric constant of the piezoelectric material, and other factors, in addition to the groove depth and width as described above.

Figure 8A:
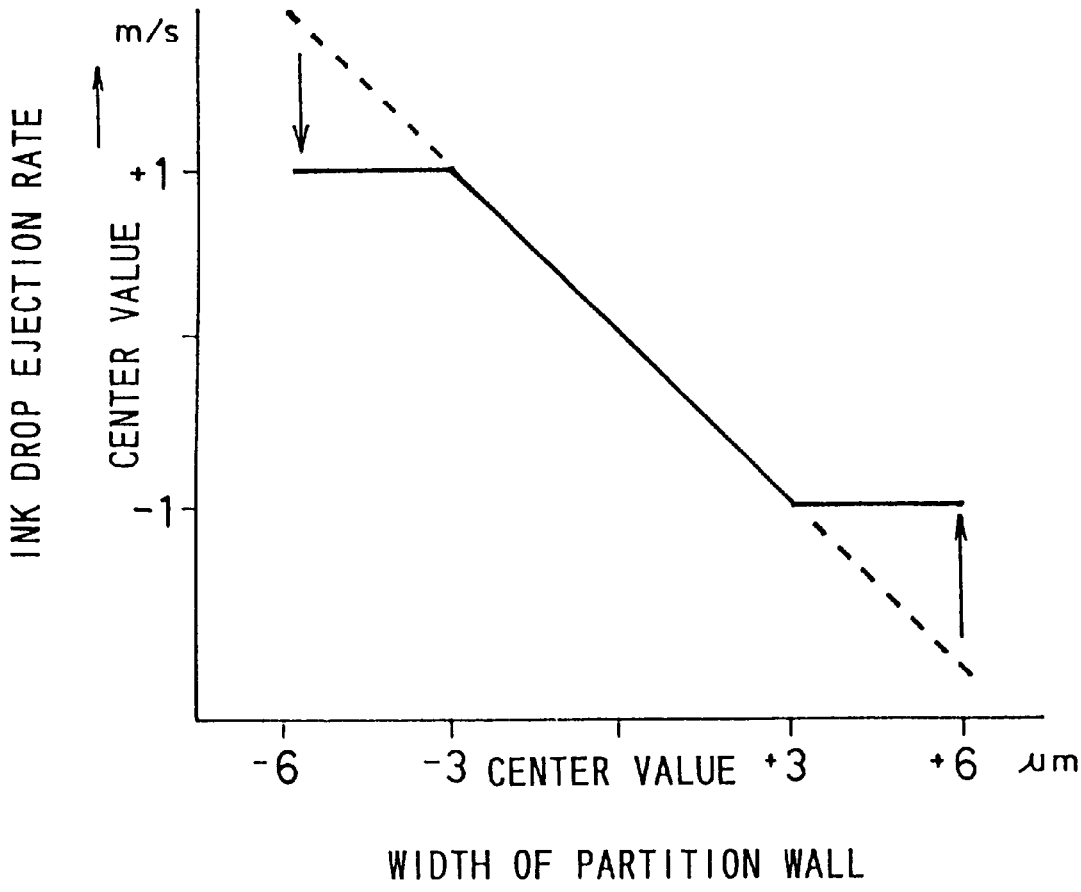
FIG. 8(A) is a graph showing the relationship between the width of partition walls and the ink drop ejection rate.
Figure 8B:
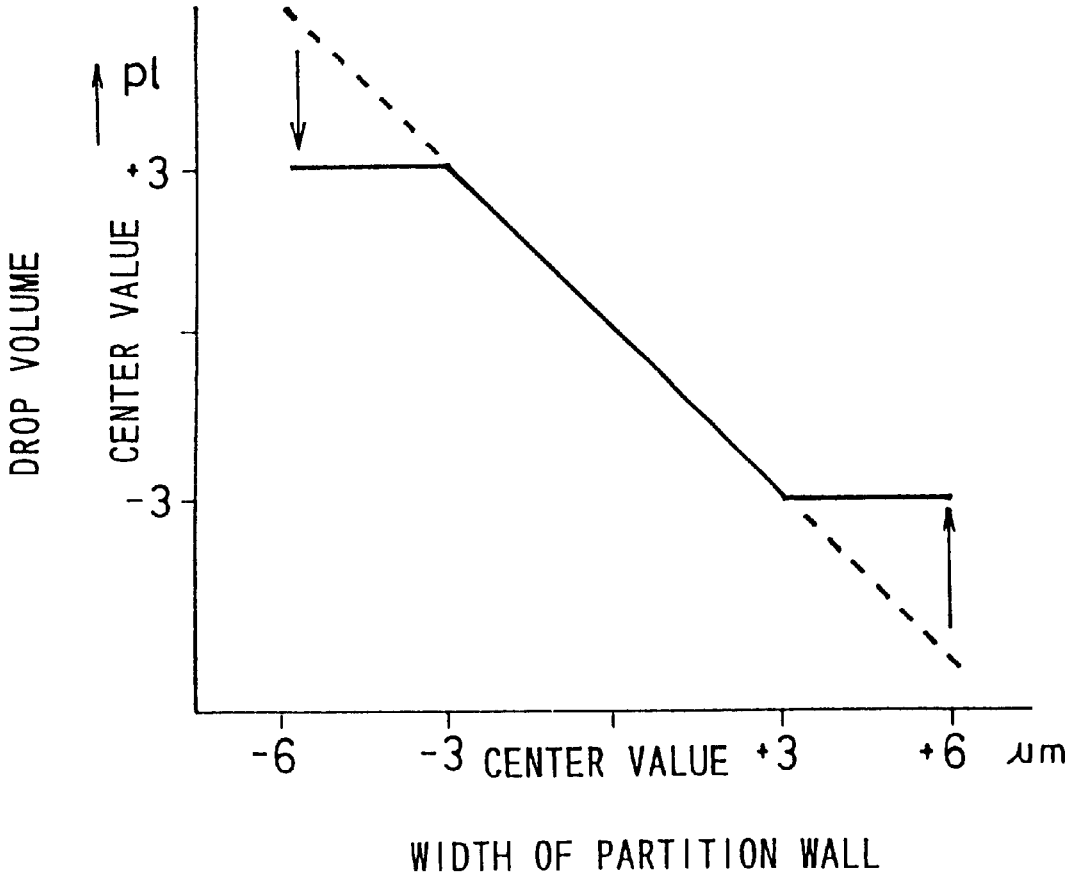
FIG. 8(B) is a graph showing the relationship between the width of partition walls and the drop volume.
Figure 8C:
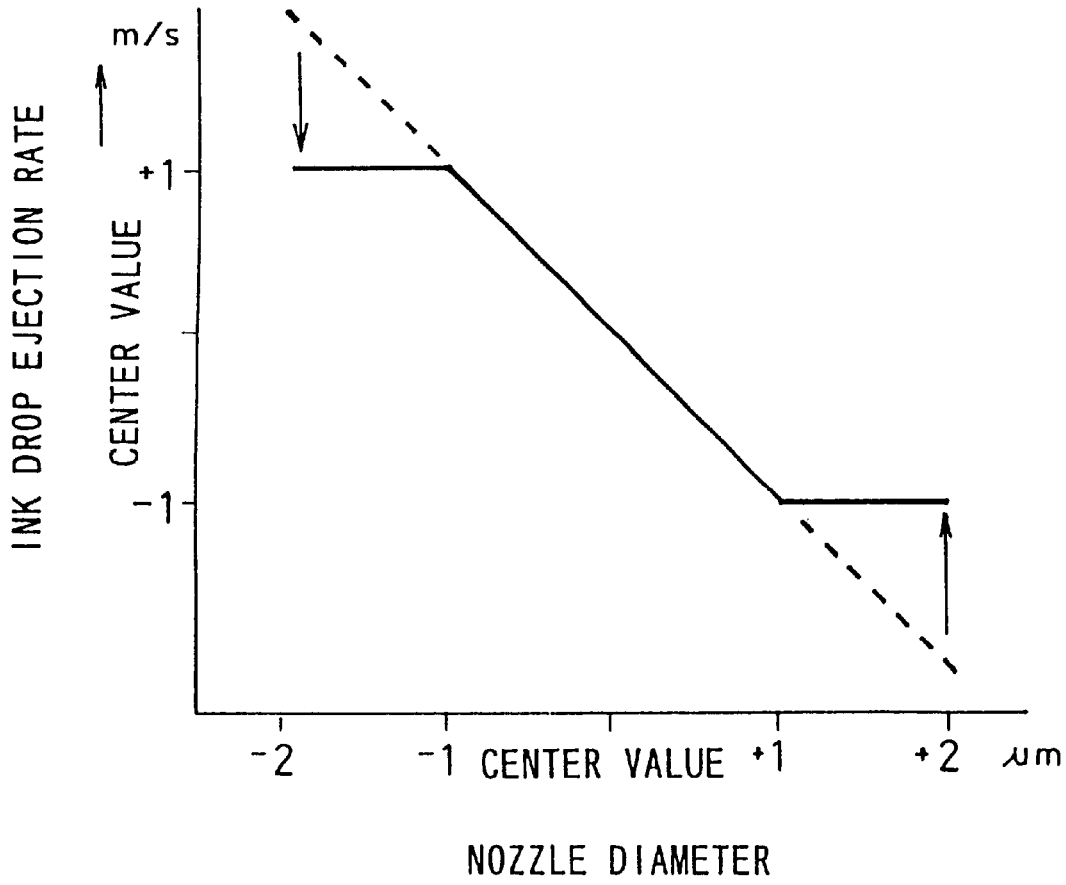
FIG. 8(C) is a graph showing the relationship between the nozzle diameter and the ink drop ejection rate.

The width of each partition wall 20, namely, the thickness of the wall between the ejection channel 10 and the non-ejection channel 11, is influenced by blade widths of respective dicing blades for forming the ink jet grooves 14 and dummy ink grooves 15, and so on. As the width of the partition wall 20 increases, the wall is less likely to be deformed, and the ink drop ejection rate and the drop volume are reduced or lowered, as shown in the graphs of FIGS. 8(A), 8(B) and 8(C). In view of this fact, when the width of the partition wall 20 comes out of its target center-value range, the groove depth of the ejection channel 10 is corrected so that the ink drop ejection rate speed and the drop volume are maintained within the target ranges around their center values. FIG. 8(C) has a center value of nozzle diameter of 30 $\mu$m.

Figure 7:
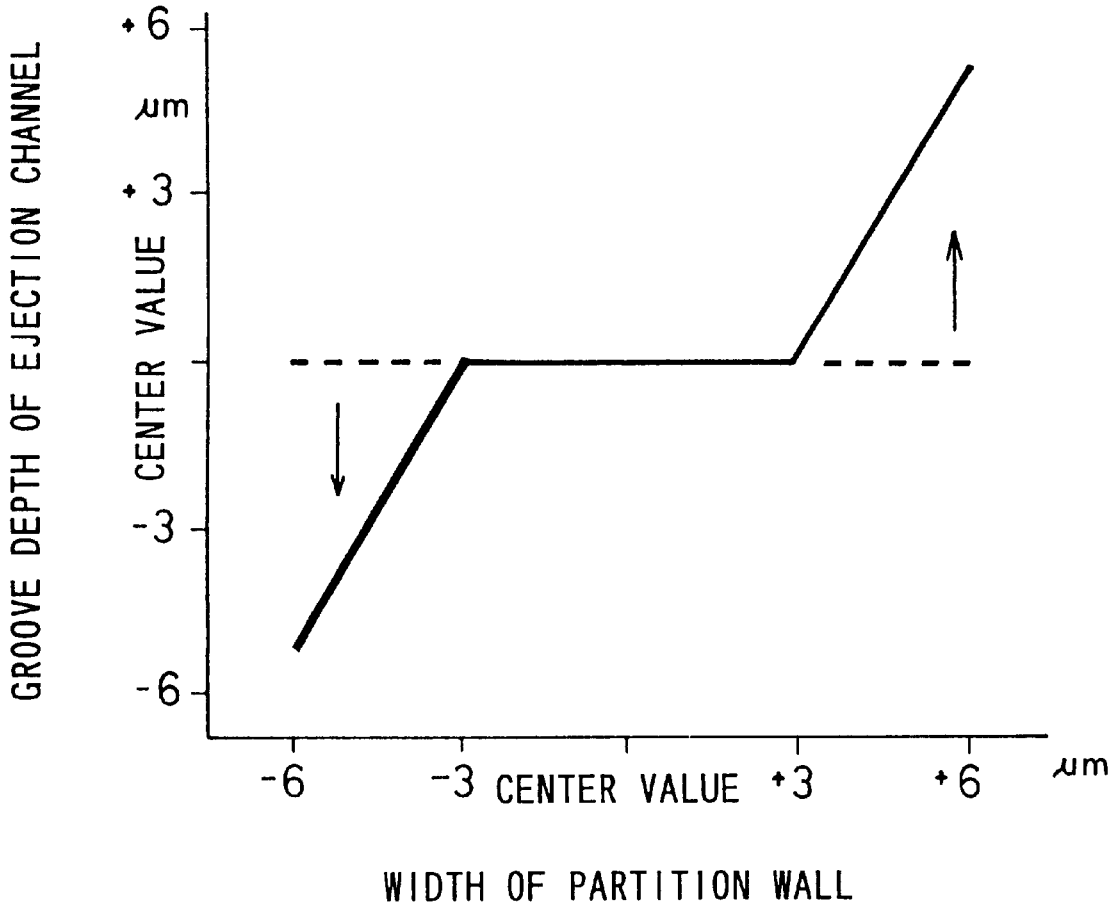
FIG. 7 is a graph showing the relationship between the width of partition walls and the groove depth.

In this operation, the width of the partition wall 20 is measured in step S9 that is executed in parallel with step S6 for measuring the groove width A, and a groove depth that corresponds to the measured width of the partition wall is derived in step S10 from a table shown in FIG. 1(D). The table shown in FIG. 1(D) indicates the relationship between the width of the partition wall and the groove depth as shown in FIG. 7, and a new actuator substrate is machined by dicing so as to be formed with grooves having the thus obtained depth in steps S2, S3, and S4. FIG. 7 has a center value of width of the partition wall of 70 $\mu$m.

The diameter of each of the nozzles 30 shows substantially the same relationship as the width of the partition walls, with respect to the ink drop ejection rate and the drop volume. Therefore, changes in the diameter of the nozzles, and consequently those of the ink drop ejection rate or drop volume, may be corrected by suitably controlling the groove depth in the same manner as described above.

Figure 9:
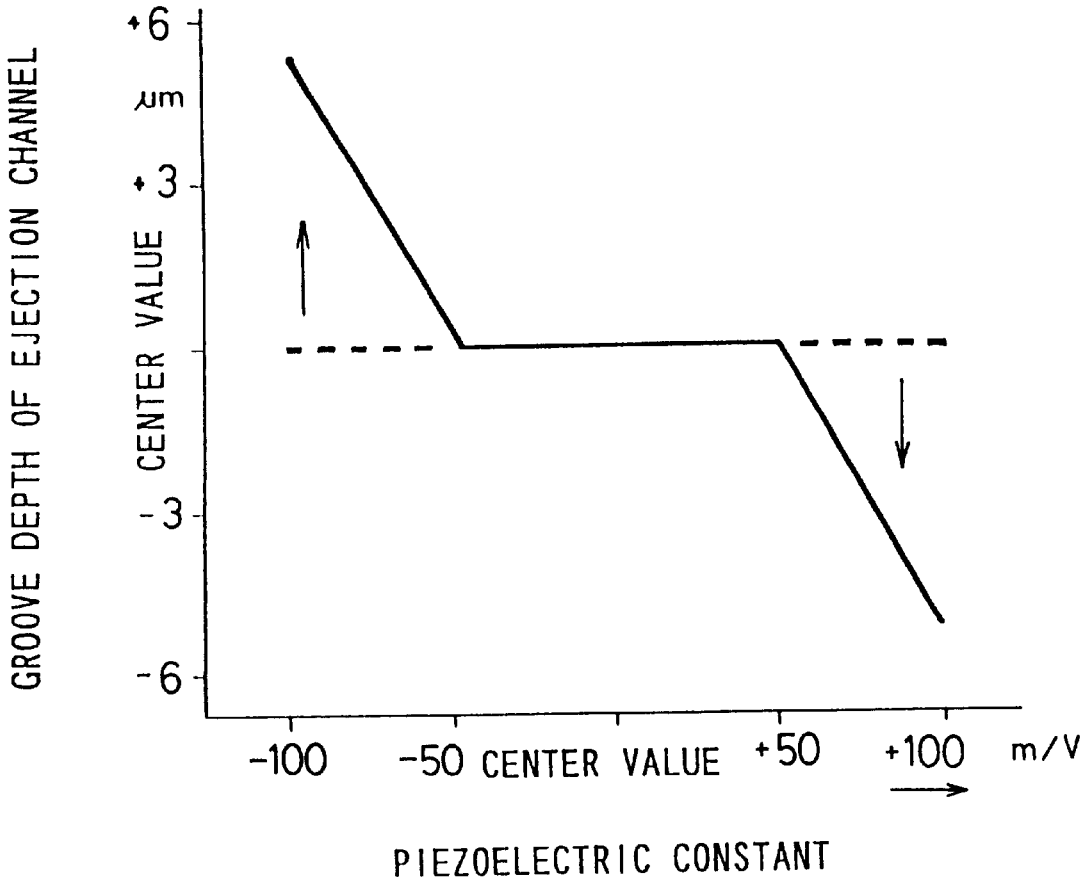
FIG. 9 is a graph showing the relationship between the piezoelectric constant and the groove depth.
Figure 10A:
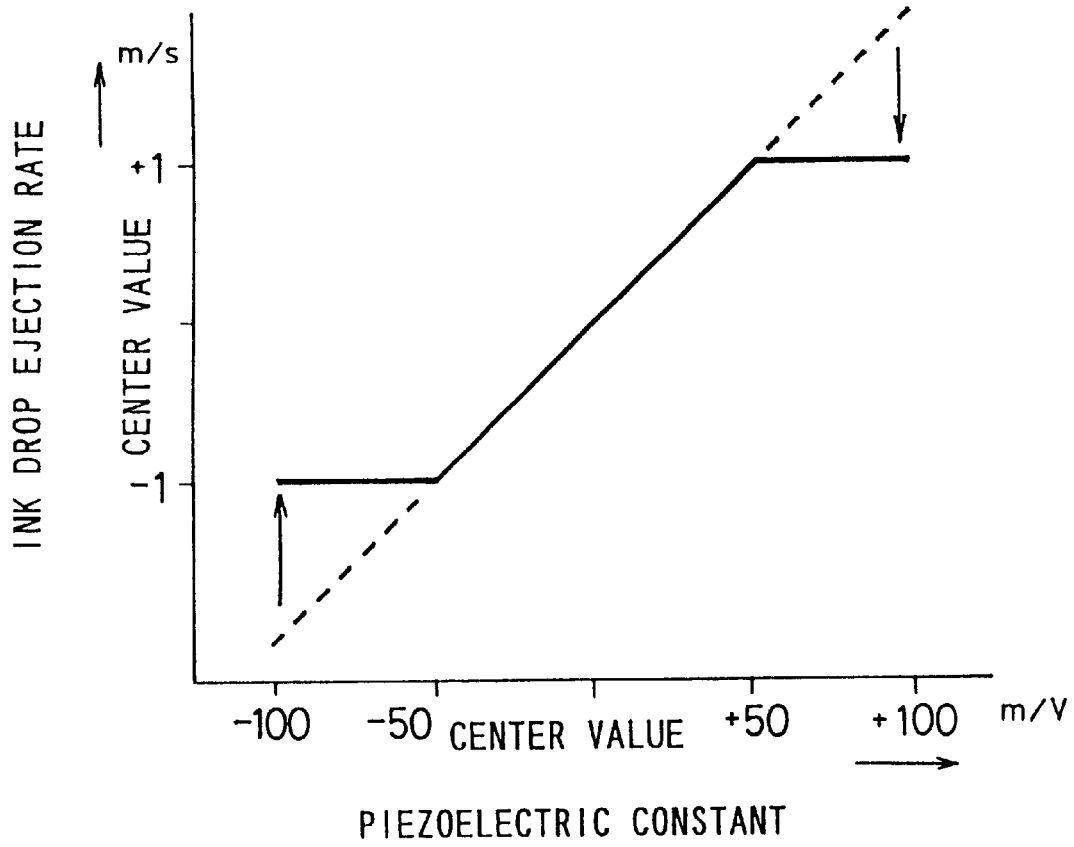
FIG. 10(A) is a graph showing the relationship between the piezoelectric constant and the ink drop ejection rate.
Figure 10B:
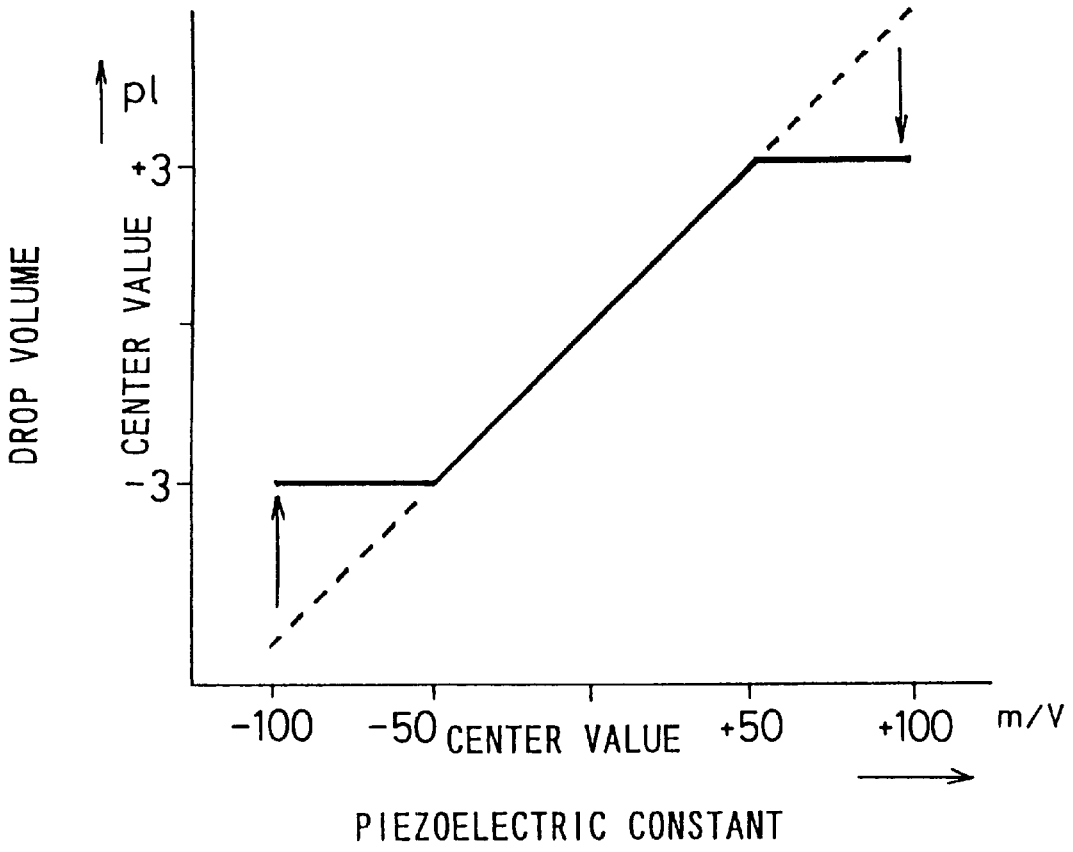
FIG. 10(B) is a graph showing the relationship between the piezoelectric constant and the drop volume.

The piezoelectric constant is represented by an amount of deformation of the piezoelectric material when a given voltage is applied to the material. As the piezoelectric constant increases, the partition walls formed of the piezoelectric material are more likely to be deformed, and the ink drop ejection rate and the drop volume are increased, as shown in the graphs of FIGS. 10(A) and 10(B). When the piezoelectric constant comes out of a target range around its center value, therefore, the groove depth of the ejection channels 10 is corrected as shown in FIG. 9, so that the ink drop ejection rate and the drop volume are maintained in respective target ranges around their center values. To this end, the piezoelectric constant of each piezoelectric material is measured in advance, and the groove depth that corresponds to the thus measured piezoelectric constant is obtained in step S8 from a table shown in FIG. 1(C). The table shown in FIG. (C) indicates the relationship between the piezoelectric constant and the groove depth as shown in FIG. 9, so that the actuator substrate is suitably machined to be formed with grooves having the thus obtained depth in steps S2, S3, and S4. FIG. 9 has a center value of piezoelectric constant of 700 m/V.

The relationship between each of the ink ejection factors and the ink ejection state may differ from that as described above, depending upon the shape of the ink jet print head. When the width of the partition walls is in an extremely small region, for example, the width and rigidness of the partition walls are substantially proportional to each other, and also substantially proportional to the ink drop ejection rate and the drop volume. In this case, too, the ejection state or characteristics can be corrected in a similar manner to that as described above.

The ejection factors, such as the groove width, groove depth, width of the partition walls, piezoelectric constant, and nozzle diameter, may be used in various combinations, so that the ink is brought into a desired ejection state (ink drop ejection rate and drop volume). In this case, appropriate ranges of the ejection factors can be broadened or increased as compared with the case where each of the ejection factors is set or controlled to be within its standard range in order to achieve a desired ink ejection state as in the conventional ink jet print head.

For example, the groove depth B can be determined based on both the groove width A and the width of the partition wall C. If the groove width is $a2<A\leqq a3$, then the groove depth is B+b1, as shown in FIG. 1(B). If the width of the partition wall is $c1<C\leqq c2$, then the groove depth is B−b2, as shown in FIG. 1(D). As a result, by combining these determinations, the groove depth is B+b1−b2.

The method of the invention may be employed in the manufacture of bubble type ink jet print heads using bubbles, as well as in the manufacture of actuator type ink jet print heads using a piezoelectric material. In either case, the ink jet head can be more easily machined, and the number of defective print heads can be reduced, thus assuring an improved yield of the print heads. The ejection factors that influence the ejection of ink for bubble jet printers include, but are not limited to, a width of an ink channel, a height of the ink channel, a width of a heater, a length of the heater, and a diameter of a nozzle. At least one of these ink ejection factors can be controlled so that ink is ejected in a predetermined ejection state.

What is claimed is:

1. A method for manufacturing an ink jet print head, comprising the steps of:

partially fabricating the ink jet head, including forming a plurality of ink grooves on a substrate;

determining values for ejection factors, that as a combination influence ejection of ink, wherein a groove depth and a groove width of the ink grooves are selected as the combination of ejection factors;

subsequently measuring one of the groove depth and the groove width of the partially fabricated ink jet print head to monitor a deviation of the values from a standard range;

re-determining the other one of the groove depth and the groove width based upon the deviation from the standard range of at least one measured ejection factor so that in use, ink in a resultant ink jet print head is ejected in a predetermined ejection state; and completing fabrication of the inkjet print head, including forming of the redetermined other of the groove depth and the groove width to form the resultant ink jet print head.

2. The method for manufacturing an inkjet print bead according to claim 1, further including the steps of forming the plurality of ink grooves such that at least one side wall of each of the ink grooves includes a piezoelectric material, and forming a plurality of nozzles that respectively communicate with the ink grooves, such that the at least one side wall is deformed upon application of a voltage thereto so that the ink is ejected from each of the ink grooves through a corresponding one of the nozzles, wherein a piezoelectric constant of the piezoelectric material and the groove depth of the ink grooves are also selected as the combination of the measured ejection factors, and the groove depth is based upon the piezoelectric constant.

3. The method for manufacturing an ink jet print head according to claim 2, further including the steps of forming the plurality of ink grooves such that at least one side wall of each of the ink grooves includes a piezoelectric material, and forming a plurality of nozzles that respectively communicate with the ink grooves, such that the ink grooves are separated from each other by a plurality of partition walls, and the at least one side wall is deformed upon application of the voltage thereto so that the ink is ejected from each of the ink grooves through a corresponding one of the nozzles, wherein a width of the partition walls on opposite sides of each of the ink grooves, and the groove depth of the ink grooves are also selected as the combination of the measured ejection factors, and the groove depth is based upon the width of the partition walls.

4. A method for manufacturing an ink jet print head, comprising the steps of:

partially fabricating the ink jet print head, including forming a plurality of ink grooves in the ink jet print head such that at least one side wall of each of the ink grooves includes a piezoelectric material;

forming a plurality of nozzles that respectively communicate with the ink grooves, such that the at least one side wall is deformed upon application of a voltage thereto so that in use, ink is ejected from each of the ink grooves through a corresponding one of the nozzles, determining values for ejection factors, that as a combination influence ejection of ink, wherein a piezoelectric constant of the piezoelectric material and a groove depth of the ink grooves are selected as the combination of the measured ejection factors, subsequently measuring at least one of the piezoelectric constant and the groove depth of the partially fabricated ink jet print head to monitor a deviation of the values from a standard range;

re-determining the other one of the piezoelectric constant and the groove depth based upon the deviation from the standard range of the measured ejection factor so that in use, ink in a resultant ink jet print bead is ejected in a predetermined ejection state; and completing fabrication of the inkjet print head, including forming of the redetermined other of the piezoelectric constant and the groove depth to form the resultant ink jet print head.

5. The method for manufacturing an ink jet print head according to claim 4, further including the step of at least partially defining each of the ink grooves with a wall formed of a piezoelectric material, such that the wall is deformed upon application of a voltage thereto so that a volume of each of the ink grooves is changed.

6. The method for manufacturing an ink jet print head according to claim 4, wherein the step of forming the plurality of ink grooves includes forming said plurality of ink grooves such that at least one side wall of each of the ink grooves includes at least one of lead zirconate titanate ceramics and lead titanate ceramics.

7. The method for manufacturing an ink jet print head according to claim 4, wherein the step of forming the plurality of ink grooves includes forming said plurality of ink grooves by dicing using diamond blades.

8. The method for manufacturing an ink jet print head according to claim 4, further including the step of forming an electrode on the at least one side wall.

9. The method for manufacturing an ink jet print head according to claim 4, further including the steps of forming the plurality of ink grooves such that at least one side wall of each of the ink grooves includes a piezoelectric material, and forming a plurality of nozzles that respectively communicate with the ink grooves, such that the ink grooves are separated from each other by a plurality of partition walls, and the at least one side wall is deformed upon application of a voltage thereto so that the ink is ejected from each of the ink grooves through a corresponding one of the nozzles, wherein a width of the partition walls opposite sides of each of the ink grooves, and a groove depth of the ink grooves are also selected as the combination of the measured ejection factors, and the groove depth is based upon the width of the partition walls.

10. A method for manufacturing an ink jet print head, comprising the steps of:

partially fabricating the ink jet print head, including forming a plurality of ink grooves such that at least one side wall of each of the ink grooves includes a piezoelectric material;

forming a plurality of nozzles that respectively communicate with the ink grooves, such that the ink grooves are separated from each other by a plurality of partition walls, and the at least one side wall is deformed upon application of a voltage thereto so that in use, ink is ejected from each of the ink grooves through a corresponding one of the nozzles, determining values for ejection factors, that as a combination influence ejection of ink, wherein a width of the partition walls on opposite sides of each of the ink grooves, and a groove depth of the ink grooves are selected as the combination of ejection factors;

subsequently measuring one of the width of the partition walls arid the groove depth of a partially fabricated ink jet print head to monitor a deviation of the values from a standard range;

re-determining the other one of the width of the partition walls and the groove depth based upon the deviation from the standard range of measured ejection factor so that in use, ink in a resultant ink jet print head is ejected in a predetermined ejection state; and completing fabrication of the ink jet print head, including forming of the re-determined other of the width of the portion walls and the groove depth to form the resultant ink jet print head.

11. The method for manufacturing an ink jet print head according to claim 10, further including the step of at least partially defining each of the ink grooves with a wall formed of a piezoelectric material, such that the wall is deformed upon application of a voltage thereto so that a volume of each of the grooves is changed.

12. The method for manufacturing an ink jet print head according to claim 10, wherein the step of forming the plurality of ink grooves includes forming said plurality of ink grooves such that at least one side wall of each of the ink grooves includes at least one of lead zirconate titanate ceramics and lead titanate ceramics.

13. The method for manufacturing an ink jet print head according to claim 10, wherein the step of forming the plurality of ink grooves includes forming said plurality of ink grooves by dicing using diamond blades.

14. The method for manufacturing an ink jet print head according to claim 10, further including the step of forming an electrode on the at least one side wall.

15. The method for manufacturing an ink jet print head according to claim 10, wherein the groove depth and, the groove width of the ink grooves are also selected as the combination of the measured ejection factors, and the groove depth is based upon the groove width.

16. A method for manufacturing an ink jet print head, comprising the steps of:

partially fabricating the ink jet print head, including forming a plurality of ink grooves such that at least one side wall of each of the ink grooves includes a piezoelectric material;

forming a plurality of nozzles that respectively communicate with the ink grooves, such that the ink Moves are separated from each other by a plurality of partition walls, and the at least one side wall is deformed upon application of a voltage thereto so that in use, ink is ejected from said each of the ink grooves through a corresponding one of the nozzles, determining values for ejection factors, that as a combination influence ejection of ink, wherein at least two of a groove depth of the ink grooves, a groove width of the ink grooves, a piezoelectric constant of the piezoelectric material, diameter of the nozzles, and a width of the partition walls on opposite sides of each of the ink grooves are selected as the combination of ejection factors;

subsequently measuring one of the at least two of the plurality of ejection factors of the partially fabricated ink jet print head to monitor a deviation of the values from a standard range;

re-determining another of the at least two of the plurality of ejection factors based upon the deviation from the standard range of the measured ejection factor so that ink is ejected in a predetermined ejection state; and completing fabrication of the ink jet print head, including forming of the re-determined another ejection factor to form the resultant ink jet print head.

17. The method for manufacturing an ink jet print head according to claim 16, further including the step of at least partially defining each of the ink grooves with a wall formed of a piezoelectric material, such that the wall is deformed upon application of a voltage thereto so that a volume of each of the grooves is changed.

18. The method for manufacturing an ink jet print head according to claim 16, wherein the step of forming the plurality of ink grooves includes forming said plurality of ink grooves such that at least one side wall of each of the ink grooves includes at least one of lead zirconate titanate ceramics and lead titanate ceramics.

19. The method for manufacturing an ink jet print head according to claim 16, wherein the step of forming the plurality of ink grooves includes forming said plurality of ink grooves by dicing using diamond blades.

20. The method for manufacturing an ink jet print head according to claim 16, further including the step of forming an electrode on the at least one side wall.

* * * * *